US009803382B1

(12) United States Patent
Mouawad

(10) Patent No.: US 9,803,382 B1
(45) Date of Patent: Oct. 31, 2017

(54) EARTHEN COMPOSITE FORMING SYSTEM

(71) Applicant: Dani Mouawad, Chapel Hill, NC (US)

(72) Inventor: Dani Mouawad, Chapel Hill, NC (US)

( * ) Notice: Subject to any disclaimer, the term of this patent is extended or adjusted under 35 U.S.C. 154(b) by 0 days.

(21) Appl. No.: 15/586,185

(22) Filed: May 3, 2017

(51) Int. Cl.
*E04B 2/84* (2006.01)
*E04G 11/22* (2006.01)
*E04G 9/04* (2006.01)
*E04G 11/08* (2006.01)

(52) U.S. Cl.
CPC ..... *E04G 11/22* (2013.01); *E04B 2/84* (2013.01); *E04G 9/04* (2013.01); *E04G 11/08* (2013.01)

(58) Field of Classification Search
CPC ..... E04B 2/84; E04B 1/167; Y10S 52/09
See application file for complete search history.

(56) References Cited

U.S. PATENT DOCUMENTS 2,400,852 A * 5/1946 Stevenson ..... E04G 17/12 249/194
2,496,616 A * 2/1950 Barton ..... E04B 2/84 264/33
2,498,325 A * 2/1950 Zemanek ..... E04G 17/12 264/308
4,947,611 A * 8/1990 Otsuka ..... E04C 2/16 52/745.05
5,021,202 A * 6/1991 Novotny ..... E04B 2/86 249/20
5,161,341 A * 11/1992 Gilles ..... B28C 5/006 239/142
6,718,722 B2 * 4/2004 Worrell ..... C04B 28/04 52/309.12
6,964,142 B1 * 11/2005 Otani ..... C04B 28/14 52/741.3
7,033,116 B1 * 4/2006 Ward ..... E04B 2/84 405/229
7,073,306 B1 * 7/2006 Hagaman ..... E04B 1/35 249/20
7,461,488 B2 * 12/2008 Black ..... E04B 1/3555 52/250
8,375,669 B2 * 2/2013 Krayenhoff ..... E04B 2/84 249/163
9,187,915 B2 * 11/2015 Jung ..... E04B 2/84
2010/0176525 A1 * 7/2010 Krayenhoff ..... E04B 2/84 264/35
2014/0352251 A1 * 12/2014 Jung ..... E04B 2/84 52/742.13

* cited by examiner

*Primary Examiner* — Rodney Mintz

(57) ABSTRACT

The present invention relates to the creation of structures comprised of earthen-mixed composites. This forming system allows for the efficient creation of structures with relatively low cost, time, and labor with exceptional accuracy. Moreover, the system employs accessible and simple construction materials, allowing users of all skill levels to create structures that may serve as dwellings, educational, working, recreational sites, and the like.

16 Claims, 8 Drawing Sheets

EARTHEN COMPOSITE FORMING SYSTEM

FIELD OF INVENTION

The present invention relates to the creation of structures comprised of earthen-mixed composites. This forming system allows for the efficient creation of structures with relatively low cost, time, and labor with exceptional accuracy. Moreover, the system employs accessible and simple construction materials, allowing users of all skill levels to create structures that may serve as dwellings, educational, working, recreational sites, and the like.

BACKGROUND OF THE INVENTION

Construction of earthen material dwellings has been known for, likely, thousands of years. For instance, Cob, is an English term, constructed near the year 1600 as a building material used since prehistoric times. Oxford English Dictionary, $2^{nd}$ ed. 2009. Named for the action needed to create a structure, to "beat" or "strike", which is now the material is applied to create a wall. As is well known, Cob is known by many names, including: adobe, lump clay, puddled clay, chalk mud, wichert, clay daubins, swish, torchis, bauge, and bousille. Many of those names are specific to the geographical origin of use.

Traditional Cob has been made by mixing clay-based subsoil with sand, straw and water. Mixing traditions are generally labor intensive. For instance, as was traditionally done in England, oxen were used to trample the mixture to create the cob material. Other methods include mixing by throwing the material onto a stone, known as cobbing. The ability to add height to the structure it dependent on the water content of the mix and climate. After such time interval (2-5 days), the walls are trimmed and the next level is built.

There is a need for a system allowing for a single user to create earthen mixture from locally sourced materials, and create a structure without the use of additional labor, at a low cost and reduce time. The present system meets such needs and provides further related advantages.

Advantages of Cob are well known; Cob is a very durable material, with earthquake and wind resistant qualities. Cob is with many health benefit qualities as it does not rot, grow mold, or attract termites. Cob blocks radioactive and electromagnetic waves. Cob is a detoxifying natural substance that contribute to air quality improvement. Cob holds a unique geothermal quality that deliver more energy saving while adding comfort due to its ability to absorb and deliver heat and humidity when needed. Cob is known to be very porous and can absorb a tremendous amount of water before it loses its structural integrity. Recent studies indicated that Cob structure is best at maintaining and diverse and healthy microbiome, crucial for our well been. Structures made from the material frequently has a foundational base of relatively non-degradable materials such as cement, stone, brick, and the like. Likewise, a roof sufficient to reduce the exposure of Cob walls to wet environments is essential for a durable Cob structure. Cob structures frequently have a thickness between one to two feet.

Disadvantages to building Cob structures are equally well known. Namely, the mixing of the Cob mixture is very labor intensive. As the wall is formed, pieces are "thrown" onto the foundation in small brick-sized globs one at a time. It is difficult to maintain uniform thickness and accurate geometric shape, along with properly leveled walls. Necessarily, to form a dwelling structure, many individuals would be needed for construction. As such, it is not uncommon to find sites that suggest hosting a "workshop" where a community of individuals come together to create a structure together.

Advantages and disadvantages of using other earthen composites for building are similar and well known.

Systems to support straight and level earthen wall formation (including Cob), are well known. These systems often include rebar, metal fencing, and complex support systems that allow earthen mixtures to be placed and to dry with uniform thickness. One such system is described in U.S. Pat. No. 2,498,325 for a "Method of Forming a Sock Pile of Sulfur." This patent describes a bracing system for forming a sulfur stock pile by using two parallel panels anchored to a certain distance apart by upside down U-shaped pieces. This system does not, however, account for larger walls that need both vertical and horizontal support. Moreover, the method for anchoring the panels to the formed wall for use is inefficient and would likely result in nonuniform thickness.

Similarly, other documents have shown methods for making earthen buildings such as U.S. Patent Application Publication No. 2014/0352251. This application describes a lattice work type frame in which earthen composite may be used to fill with pugging clay to create structures. The lattice-work mold is intended to be temporary, allowing for the mold to be reused within the construction of the structure. Likewise, EP 0245180 B1 describes a method for building walls with muddled clay, the walls described therein have multiple layers with structural supports therein. An array of other documents similarly describe methods using encased structural support for the construction of earthen walls. See U.S. Pat. No. 6,718,722 and U.S. Pat. No. 7,073,306.

Thus, current methods for earthen composite structures remains labor intense. Even with the methods described, structures built often suffer from various thicknesses of the walls, which compromises the integrity of the structure. Use of the methods described requires skill, and those who are unskilled would have difficulty in creating a successful earthen composite structure.

For those seeking to build structures with natural materials (a number that continues to rise with concern over environmental pollutants within the home), they face up to three-fold cost when compared to traditional materials.

Thus, there is a need for a method for the construction of earthen composite structures that is simple, easily accessible by a lay person, comprising accessible and standard materials, affordable, not labor intensive, comprising materials having secondary uses, ecological, and time-saving. A versatile system that deliver accuracy and flexibility when it comes complex geometric structure in all three structural axles. Such accuracy is required by structural engineers and expected by code officials. The ability to pacify engineers and code officials is necessary to create useful earthen composite structures.

BRIEF SUMMARY OF THE INVENTION

The present invention describes an earthen composite forming system that accomplishes all the needs. The earthen composite forming system shows a construction cost well below conventional construction, and up to thirty-fold reduction in labor force. Cost saved from such a drastic reduction in labor force adds significantly to overall cost saved (as more than 80% of cost is labor related). The system provides the required accuracy demanded by structural engineers and expected by code officials. The system provides the flexibility essential for replicable construction models.

The efficient earthen composite structure system of the present invention provides significant cost, time, quality, and labor benefit to known systems.

In one embodiment, the forming system consists of vertically placed vertical studs, which are paired with a left and right stud to form vertical column, the vertical columns placed at an inner and outer side of all corners of a building structure. A plate that is angled to achieve the desired shape of the building connects the left and right vertical stud, in this embodiment, to form a vertical column. The vertical columns are tied to each other at predetermined intervals with threaded rods between the base and the top. The bottom of the vertical columns may sit, or be tied to foundational elements with fasteners and a plate secured to the top of the column secures the top.

In other embodiments, the forming system consists of a pair (a left and right) of vertical 2"×6"×16' placed studs, creating a vertical column, wherein two vertical columns are placed at the inner and outer side of all corners of the building structure. Each pair vertical studs are connected to each other by an 8"×8" aluminum plates that are ⅛" thick. The angle of the aluminum plate (as it is bent in a midline) being determined by the desired shape of the building (e.g., wherein the structure is 4 sided, a 90° at its midline, and where the structure is eight-sided, a 135° at its midline).

Furthermore, in that embodiment, the inner and outer vertical columns are tied in with each other at preset intervals with a plurality of threaded rods between the base and the top of the vertical columns. The pairs of vertical columns rest (e.g., sit) or may be tied to foundational elements at their base (e.g., cinderblocks, stone, brick, cement, etc.) with fasteners appropriate to the foundational element material and tied at the upper end with studs extending across each set of vertical columns, further stabilizing the forming system. A top plate is fastened to the top of the pair of columns to define and maintain a desired wall thickness, and assure stability of the forms.

In one exemplary embodiment, the vertical columns are tied with each other via a bent plate at 36" intervals, and a plurality of ¼" threaded rods at 12 or 24" intervals, between the base and the top. The bottom end, in this embodiment, is resting to the foundational elements (e.g., cinderblocks, stone, brick, cement, etc.). The vertical columns resting on the well-leveled foundational element, and at the upper end, ties in with 2"×4" timber studs that extend across each vertical column to assure further stability of the forming system. A top (2"×12"×2') wooden jig is nailed to the top of the column to secure the intended wall thickness and overall stability of the forms.

In other embodiments, once the vertical columns are erected and plumbed, a plurality of pairs of horizontal boards are placed on the inner and outer corners of the vertical columns, such that they bridge between the left and right vertical studs on the outer and inner perimeter of the structure. The horizontal boards first being placed at the base of the vertical columns. The horizontal board on the inner and outer perimeter being in connection with a left vertical stud at one corner and a right vertical stud at an adjacent corner. The left and right vertical stud connected by a plate to the horizontal board, the horizontal board being connected to one vertical stud at each end of the horizontal board. In these embodiments, reinforcement stiffeners are added to maintain integrity of the horizontal boards. In those embodiments, the reinforcing horizontal and vertical stiffeners are exterior to the wall to be formed by the inner and outer perimeter.

In one exemplary embodiment, once the vertical columns are erected and plumbed, horizontal 2"×12" boards having 2"×4" reinforcement horizontal and vertical stiffeners previously placed at the top, bottom and sides of the boards, the horizontal boards bridging between each corner formed by the vertical columns. In these embodiments, a left or right vertical stud and horizontal boards are connected to a left or right vertical stud by an 8"×8" aluminum plate, ⅛" thick. A pair of horizontal boards at the inner and outer border delineated by the vertical columns. A plurality of pairs of horizontal boards at all corners of the structure, defining an inner and outer perimeter, created by the forming system and on the same horizontal plane.

In most embodiments, the inner and outer horizontal boards create a cavity space where Cob mix will be delivered mechanically with an excavator, a mini-excavator, or equivalent. Moreover, the Cob mix may be created adjacent to where it will be placed, or be moved by any means (such as by mini-excavator, hand, wheelbarrow, truck, tractor and the like). In some embodiments, mini-excavators may be used for mixing the Cob, or earthen composite, materials.

In a preferred embodiment, while the forming system is in place it may be protected from the elements with plastic sheets hanging from the top and across the columns of the forming system. The extend of such prevention is contingent on the amount of rain and wind for that region.

In another embodiment, once the earthen composite mixture is delivered into the forms created by the horizontal boards attached to the vertical columns at desired intervals (e.g. at 4", 6", 8", 10" or 12" intervals), over an appropriate period to allow for drying (e.g., 0.0 days, 0.5 days, 1 day, 2 days, 3 days, 4 days, or 5 days) before repeating the same lift (above the wall previously formed) of the horizontal board to a next forming position until the wall is completed.

In an exemplary embodiment, the earthen composite mixture is delivered into the forms at 9" intervals, and is compacted to 6". No waiting time is needed in this preferred embodiment. In other embodiments, an earthen composite mixture is delivered into the forms at 6-10", and dries for a period of 2-5 days before initiating a new cycle by repeating the same lift of the same horizontal board until the wall is complete. In some preferred embodiments, Cob is used as the earthen composite mixture. The environment of use as well as the percentile of water content determines drying time. It is important to note that the builder has the option to create the earthen composite mixture with less water content followed with manual or mechanical compaction into the forms. In some embodiments, little to no waiting time will be necessary before raising the horizontal board to a next forming position until the wall is completed.

In some embodiments, the earthen composite forming system may be employed to form a wall, or a structure, as desired.

The preceding is a simplified summary to provide an understanding of some embodiments of the present invention. This summary is neither an exhaustive nor extensive overview of the present invention and its various embodiments. The summary presents selected concepts of the embodiments of the present invention in a simplified form as an introduction to the more detailed description presented below. As will be appreciated, other embodiments of the present invention are possible utilizing alone or in combination, one or more of the features set forth above or described in detail below.

These and other aspects of the present invention will become evident upon reference to the following detailed description and attached drawings.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments presently preferred, it being understood, however, the embodiments disclosed herein are not limited to the specific instrumentalities disclosed. Included in the drawings are the following figures.

Figure 1:
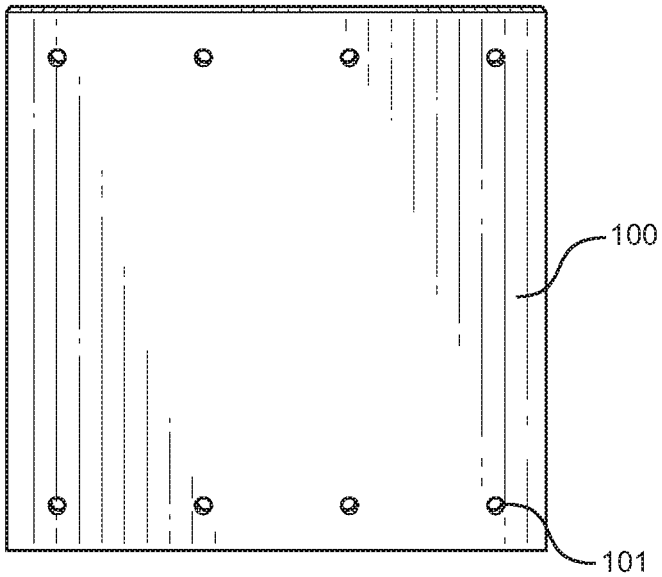
FIG. 1 is an illustration of an aluminum plate that connects the horizontal boards with the related left or right vertical studs, as in one embodiment of the present invention.

While embodiments of the present invention are described herein by way of example using several illustrative drawings, those stilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application the word "may" is used in a permissive sense (e.g., meaning having potential to) rather than the mandatory sense (e.g., meaning must). Similarly, the words "include," "including," and "includes" mean including but not limited to. To facilitate understanding, like reference numerals have been used, where possible to designate like elements common to the figures.

DETAILED DESCRIPTION OF THE INVENTION

Provided herein is a description of a system for creating structures from earthen composites, or an earthen composite structural forming system.

Throughout this application, references are made to various embodiments relating to the system and its implementation. The various embodiments described are meant to provide a variety of illustrative examples and should not be construed as descriptions of alternative species. Rather it should be noted that the descriptions of various embodiments provided herein may be of overlapping scope. The embodiments discussed herein are merely illustrative and are not meant to limit the scope of the system for earthen composite structure construction.

In the present description, any concentration range, percentage range, ratio range or other integer range is to be understood to include the value of any integer within the recited range and, when appropriate, fractions thereof (such as one tenth and one hundredth of an integer), unless otherwise indicated. As used herein, "about" or "comprising essentially of" means +/−15%. The use of alternative (i.e., or) should be understood to mean one, both, or any combination thereof of the alternatives. As used herein, the use of an indefinite article, such as "a" or "an," should be understood to refer to the singular and the plural of a noun or noun phrase.

An inventory list is attached is described below in "EXAMPLE 1." The same reflect how accessible and interchangeable the materials used in the earthen composite structural forming system are intended.

FIG. 1 illustrates the a flat plate 100 with a plurality of apertures 101. In one preferred embodiment, the flat aluminum plate 100 is 8"×8"×⅛" having eight 3/16" apertures 101. The apertures 101 capable of receiving a fastener to secure to separate pieces together. In a preferred embodiment, the aluminum plate 100 is used to secure a left 124 or a right 125 vertical stud to an end of a horizontal forming board 105, described, infra. The use of aluminum plates 100 permit the stiffness needed while preventing wood of the vertical stud 124 or 125 or horizontal forming board 105 from splitting. Other materials are contemplated for the flat plate 100 and do not depart from the scope of the invention. For instance, the flat plate 100 may be made of synthetic rubbers, composites, epoxies, or metals that have similar malleability properties to aluminum.

Use of alternate materials which maintain integrity of the vertical stud 124 or 125 and the horizontal board 105 are contemplated and do not depart from the scope of the invention. Fasteners, as described herein, mean any type of material fastener such as nails, screws, rods, staples, injectables, and the like. Moreover fasteners may be expanded to include materials functioning without the use of apertures such as glues, epoxies, resins, and the like.

Figure 2:
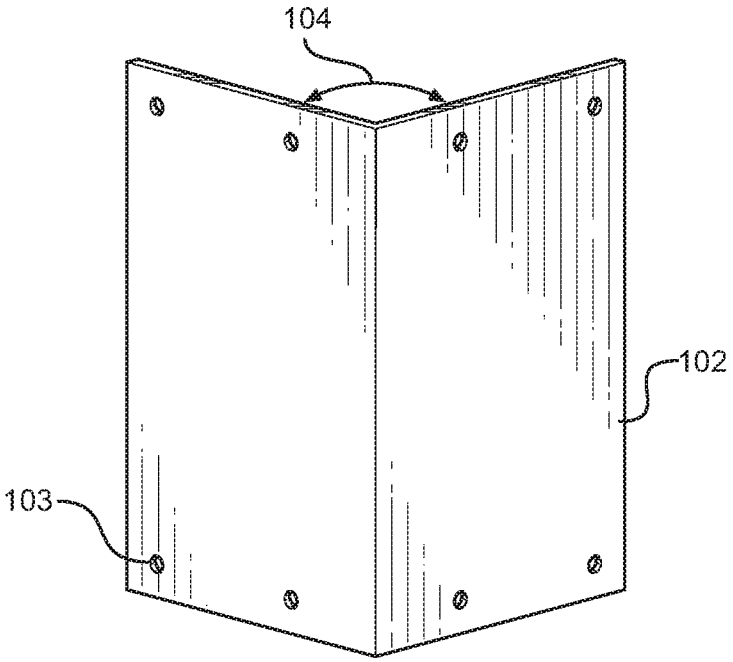
FIG. 2 is an illustration of a bent aluminum plate to connect two vertical studs to form a vertical column, as in one embodiment of the present invention.

FIG. 2 illustrates a bent plate 102 with a plurality of apertures 103 having an angle 104. The apertures 103 capable of receiving a fastener to secure to separate pieces together. In a preferred embodiment the bent plate 102 is an 8"×8"×⅛" aluminum plate having four 3/16" predrilled apertures 103. The plate 102 connects a left 124 and a right 125 vertical stud to create a vertical column 110. The aluminum in the preferred embodiment, permits strength and stiffness needed while preventing potential wood splitting of the vertical studs 124 or 125.

Other materials are contemplated for the bent plate 102 and do not depart from the scope of the invention. For instance, the bent plate 102 may be made of synthetic rubbers, composites, epoxies, or metals that have similar malleability properties to aluminum. Use of alternate materials which maintain integrity of the vertical studs 124 or 125 and the horizontal board 105 are contemplated and do not depart from the scope of the invention.

The angle 104 of the bent plate may vary depending on the number of sides in the earthen composite structural forming system, wherein the formula for any polygon is: n−2(180)/n where n is the number of sides and equal angles are desired at each corner. Where variance in wall length is contemplated, the sum of the angles needed can be achieved by using the formula n−2(180), where n is the number of sides. (e.g., where 4 equal walls are contemplated, the bent plate 102 is angled 104 at 90°; where 6 equal walls are contemplated, the bent plate 102 is angled 104 at 120°; where 8 equal walls are contemplated, the bent plate 102 is angled 104 at 135°, etc.). In other embodiments, a flat plate 100 can be used to secure the horizontal board 105 to the vertical column 110, the inner and outer vertical column 110 used to create a wall.

Figure 3A:
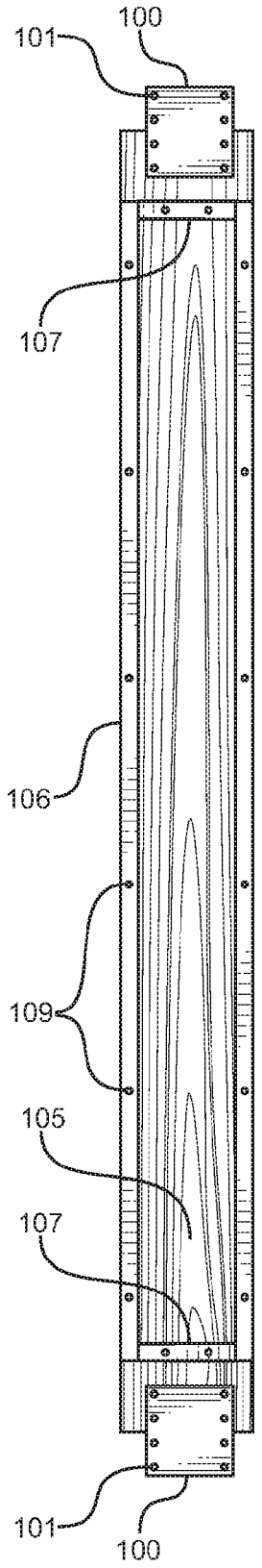
FIG. 3A is an isometric rendering of a horizontal board with reinforcement horizontal and vertical stiffeners, as in one embodiment of the present invention.

FIG. 3A shows the horizontal board 105 comprising the board 105 and rectangular stiffeners 106 and 107. In one preferred embodiment the horizontal board 105 is 2"×12"×12' dimension. In some embodiments the horizontal board 105 is made of wood. Other materials may be used for the horizontal board 105 such as plastics, synthetics, epoxies, rubbers, resins, metals, and the like, and do not depart from the scope of the invention. Attached to the horizontal board 105 are horizontal stiffeners 106 and vertical stiffeners 107 to prevent any significant bowing of the form when packed with Cob. The stiffeners 106 and 107 will face exterior to the forming wall when in use with the forming system. In a preferred embodiment, two horizontal boards 105 are used in each cycle, an upper and lower horizontal board 105 as described below.

In one preferred embodiment the horizontal stiffeners 106 are 2"×4"×10', and the vertical stiffeners 107 are 2"×4"×8.5". In some embodiments the stiffeners 106 and 107 is made of wood. Other materials may be used for the studs 106 and 107 such as plastics, synthetics, epoxies, rubbers, resins, metals, and the like, and do not depart from the scope of the invention.

Figure 3B:
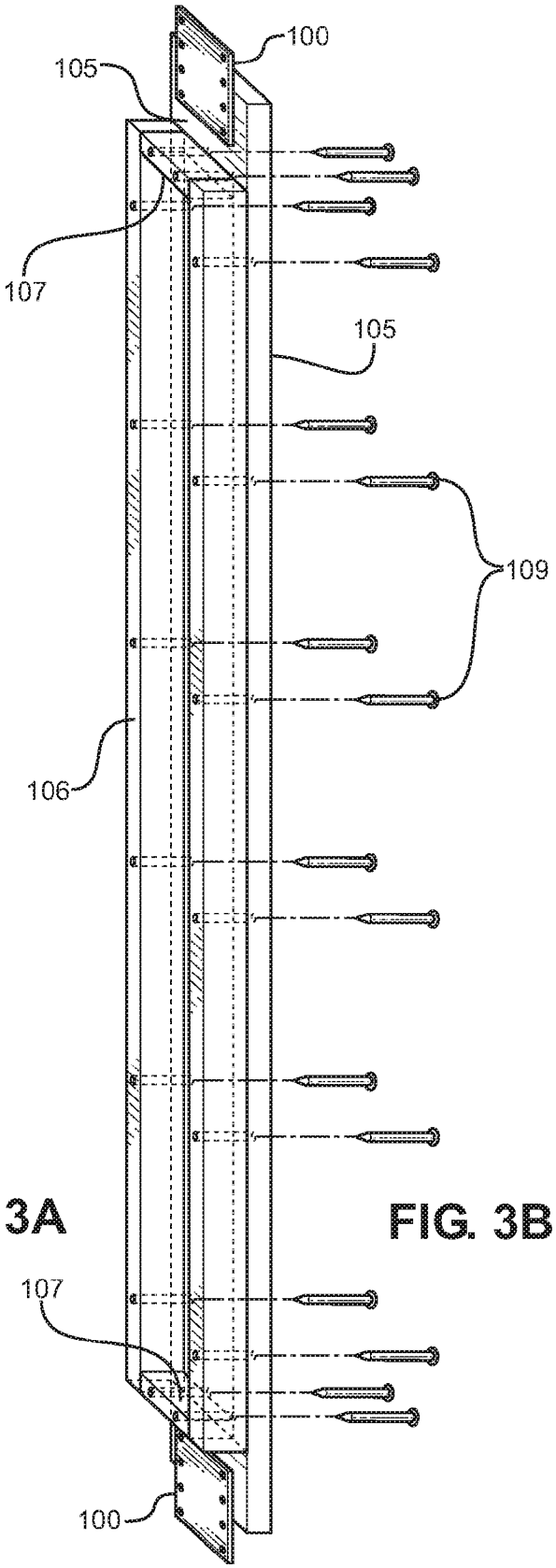
FIG. 3B is a side view of the horizontal board with reinforcement horizontal and vertical stiffeners and fastening plates to the vertical stud, as in one embodiment of the present invention.

As shown in FIG. 3B, the vertical and horizontal reinforcement stiffeners 106 and 107, no matter their dimension, are 6" short from each side of the horizontal board 105 to permit enough space for the flat plate 100, which adheres the horizontal board 105 to a vertical column 110 via fasteners and the apertures 101 provided. Other dimensions do not depart from the scope of the invention, the stiffeners 106 and 107 are placed interior from the edge of the horizontal board 105 to facilitate ease of handling. The stiffeners 106 and 107 are, in one preferred embodiment, are fastened to the horizontal board 105 with a plurality of screws or nails 109. Wherein, in many embodiments, the side of the horizontal board 105 having the reinforcement vertical and horizontal stiffeners 106 and 107 is placed exterior from the formed or forming wall when in use with the earthen composite structural system.

Figure 4A:
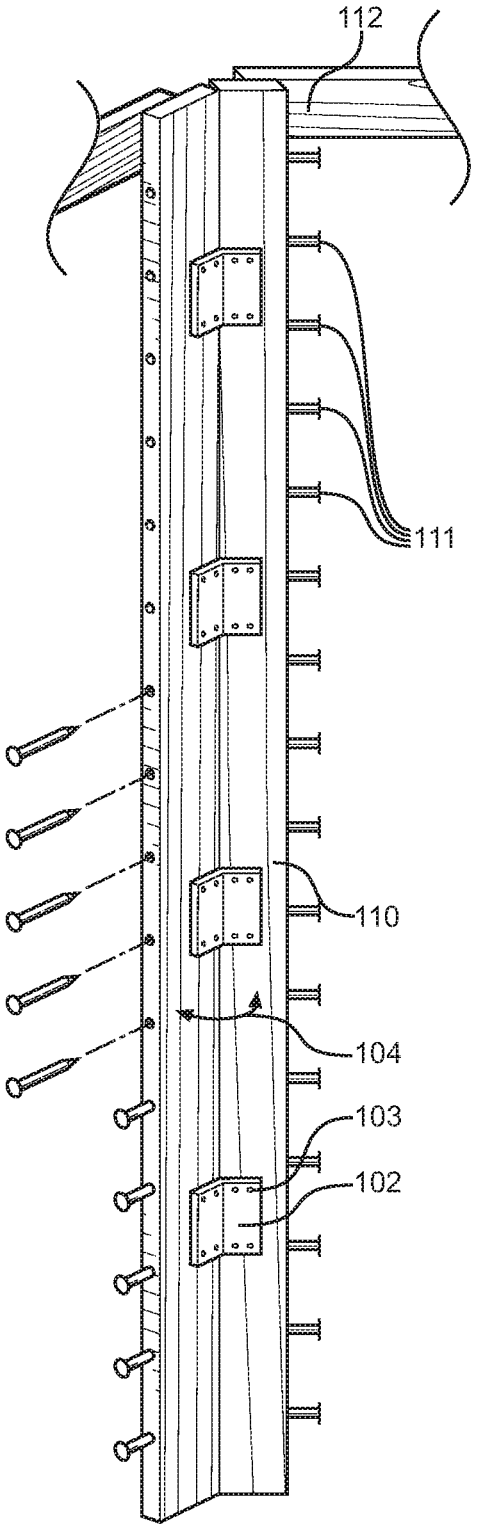
FIG. 4A is a front view of the vertical column, the studs connected by the bent aluminum plate intervals and a plurality of openings (e.g., predrilled) that may hold a protruding rod (e.g., double headed 3" nail) at one foot intervals on either side of the column were the horizontal form can rest prior to be tightened to the vertical columns, as in one embodiment of the present invention.
Figure 4B:
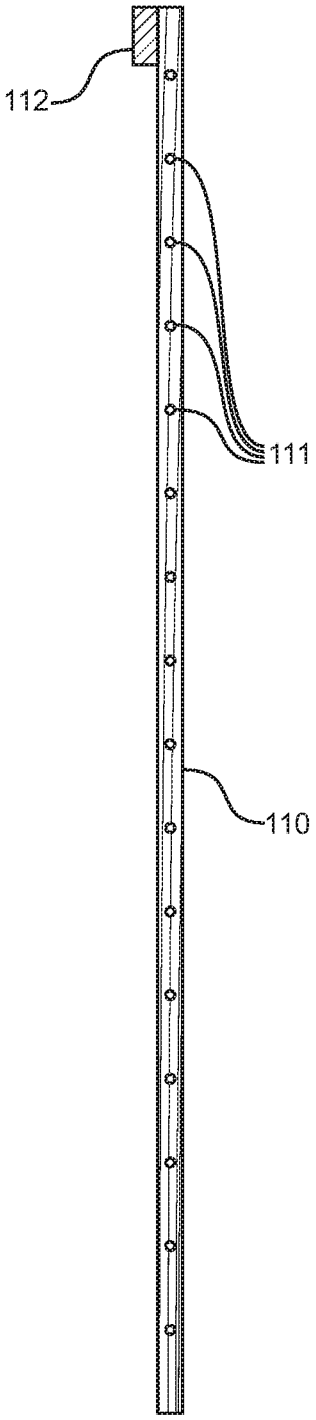
FIG. 4B is a side view of the vertical column with bent aluminum plates and openings (e.g., predrilled) with protruding rods (e.g., double headed 3" nail), as in one embodiment of the present invention.

FIGS. 4A and 4B highlight the details of the vertical columns 110 including the double headed nailing position 111 that facilitates the progressive placement of the horizontal boards 105 as the wall formation progresses vertically. In some preferred embodiments, the vertical columns 110 comprise wood. In other embodiments, the vertical columns 110 comprise plastics, synthetics, epoxies, rubbers, resins, metals, and the like, and do not depart from the scope of the invention. In FIG. 4A, a side view of the vertical columns 110 is provided. A left 124 and right 125 2"×6"×16' vertical studs are placed vertically, and secured at a desired angle by a bent plate 102 to create a vertical column 110. Moreover, an upper connecting stud 112 is provided at the uppermost portion of the vertical column 110. The connecting stud 112 serving to connect the sides of inner and outer vertical columns 110 of the earthen composite structure in its final formation.

The apertures 103 provided in the bent plate may be used with screws, nails, or the like, as in many embodiments of the present invention. Alternatively, other means of adhering two vertical studs 124 and 125 at a desired angle are contemplated and do not depart from the scope of the invention. Moreover, nailing positions 111 capable of accepting protrusions to anchor horizontal boards 105 are provided on the outward facing side of the vertical column 110. In some embodiments, the nailing positions 111 receive double headed nails. In one preferred embodiment, the nailing positions 111 are spaced at 1 foot and receive 3" double headed nails. FIG. 4B shows a side view of an exemplary vertical column 110. This aspect shows the spacing of the nailing positions 111.

Figure 5:
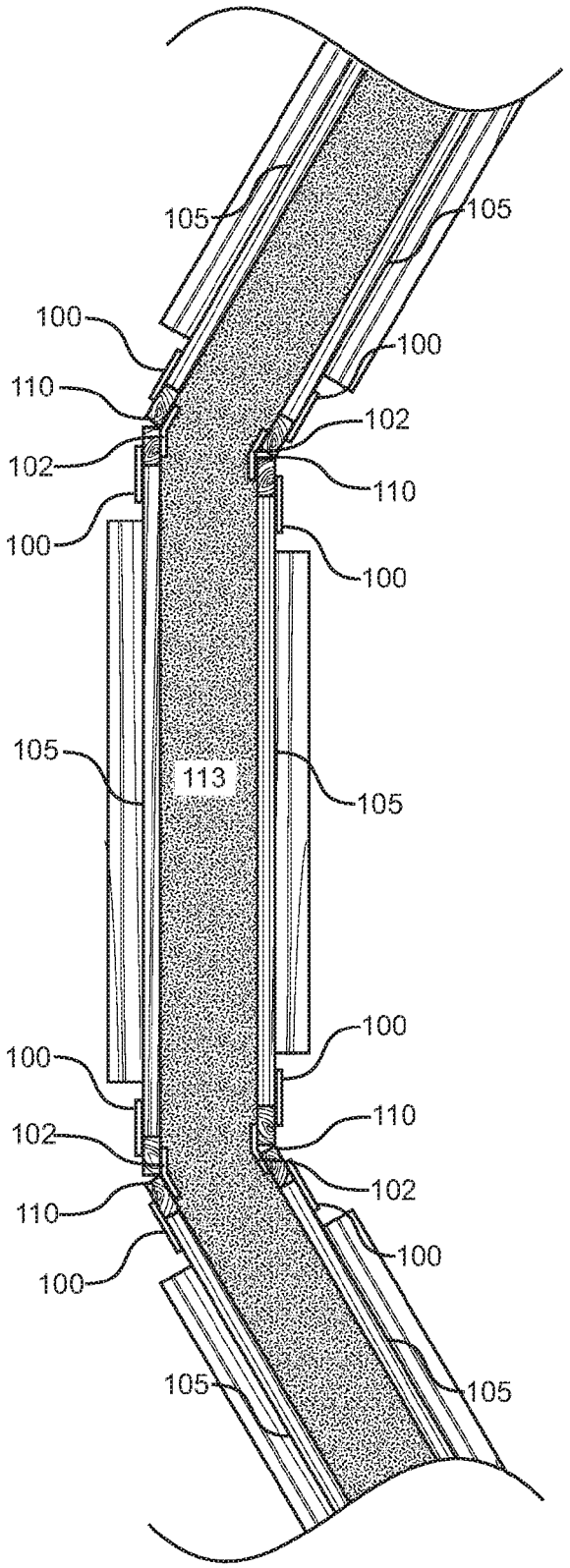
FIG. 5 is an illustration on a plain view, showing connection of the horizontal boards to the vertical columns by at least one plate, as in one embodiment of the present invention.

FIG. 5 shows a plan view of the forming system forming a cavity for the reception of the earthen composite 113. The an inner horizontal board 105 is connected to adjacent inner vertical columns 110 by flat plates 100. Similarly, an outer horizontal board 105 is connected to adjacent outer vertical columns 110 by flat plates 100. Bent plates 102 connect the left 124 and right 125 vertical studs to create the inner and outer vertical columns 110 at each corner having an angle 104. The interstitial space between the inner pair and outer pair of vertical columns 110 is to be filled with wet or uncompacted earthen composite 113 to create a wall. In most preferred embodiments, the uncompacted earthen composite 113 is Cob or compacted earthen mix. In some embodiments, the inner and outer pairs of vertical columns have an angle of 180° 104, (e.g., are not bent) in those embodiments the earthen composite forming system is used to create an extended wall.

Figure 6A:
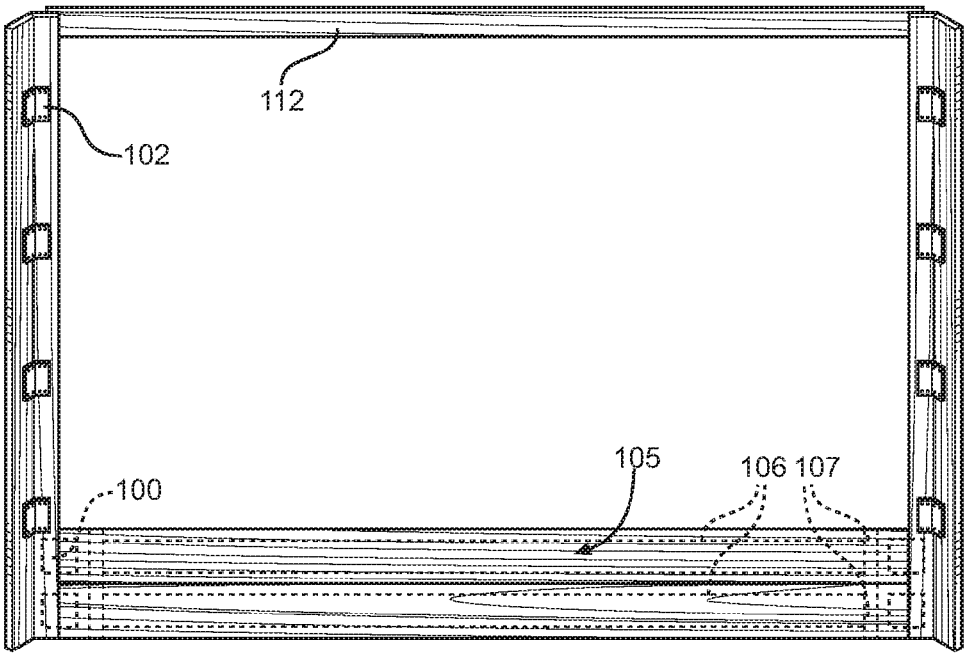
FIG. 6A is an illustration of the façade view of lower horizontal boards at a base position, which will be raised above the upper board each time that the earthen composite mixture fills the cavity, as in one embodiment of the present invention.

FIG. 6A is side view of the earthen composite structural forming system. The upper and lower horizontal boards 105 are first placed at the base of the vertical columns 110. Wet or uncompacted earthen composite 113 will be transferred to the interstitial space between the inner and outer pairs of vertical columns 110, and inner and outer horizontal boards 105, the horizontal boards 105 being adhered to the vertical columns 110 by plates 100. Once the interstitial space is filled with earthen composite 113, the earthen composite 113 is dried or compacted such that dry-time is not required. Where required in some embodiments, drying of the earthen composite 113 is achieved by simple evaporation into the surrounding environment. As such, it is well known by those skilled in the art that earthen composite 113 that has a higher water content, or is in a relatively humid environment (e.g., the Amazon jungle), will have a lengthier dry-time, than that with a lower water content, or that in an arid environment (e.g., the Sahara desert).

Figure 6B:
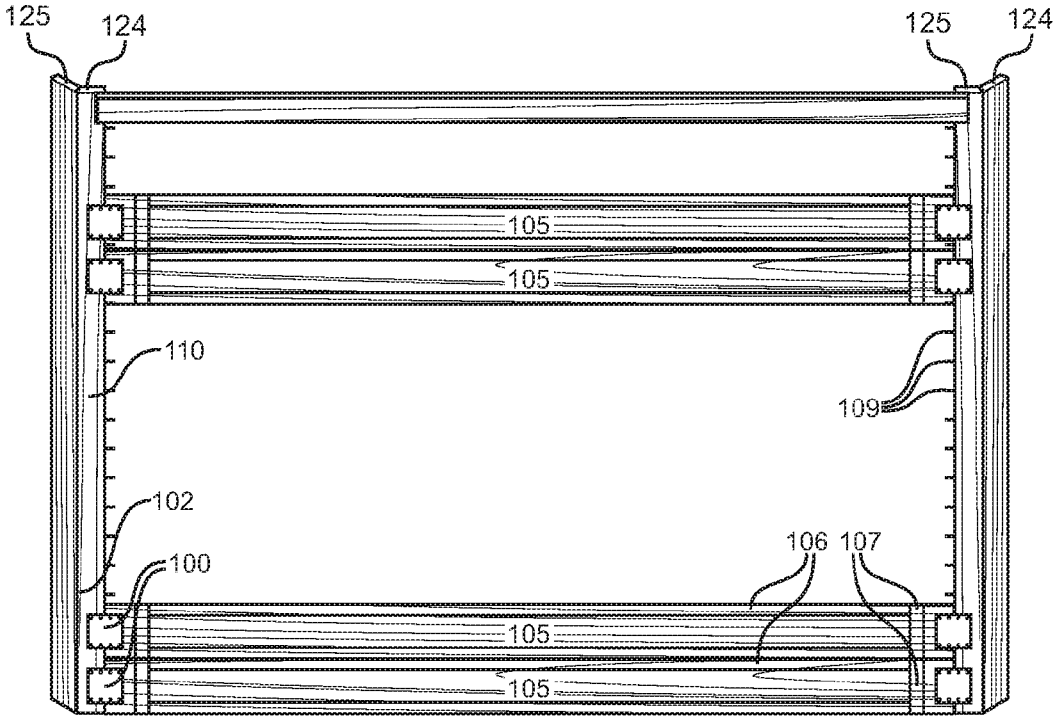
FIG. 6B an illustration of the façade view of lower horizontal boards at a position ⅔ above the base position, which will be raised above the upper board each time that the earthen composite mixture fills the cavity, as in one embodiment of the present invention

In some embodiments, it is contemplated that the wet, uncompacted earthen mixture 113 can be formulated with such low water (aqueous) content such that the earthen mixture 113 will require no dry time where properly compacted. For other mixtures or environments, sufficient dry time will vary from 0-5 days. Once the earthen mixture is dried or compacted 121 (dried or compacted earthen mixture), the horizontal boards 105 may be moved vertically by the same height as the sufficiently dried earthen mixture 121. In preferred embodiments, the lower horizontal board 105 is removed and placed above the upper horizontal board 105 after the earthen mixture 113 is sufficiently dry. The apertures with double headed nails 111 serving as a platform to support the horizontal boards 105 in their next forming position. In an exemplary embodiments, the lower horizontal board 105 will be removed from the base position relative to the vertical columns 110 and placed above the upper horizontal board 105 and sufficiently dried earthen mixture 121 in a sequential way each time that the horizontal and vertical based forms (110 and 105) are filled and compacted. As shown in FIG. 6B, the forms are about ⅔ of the way up the vertical columns 110.

Figure 7A:
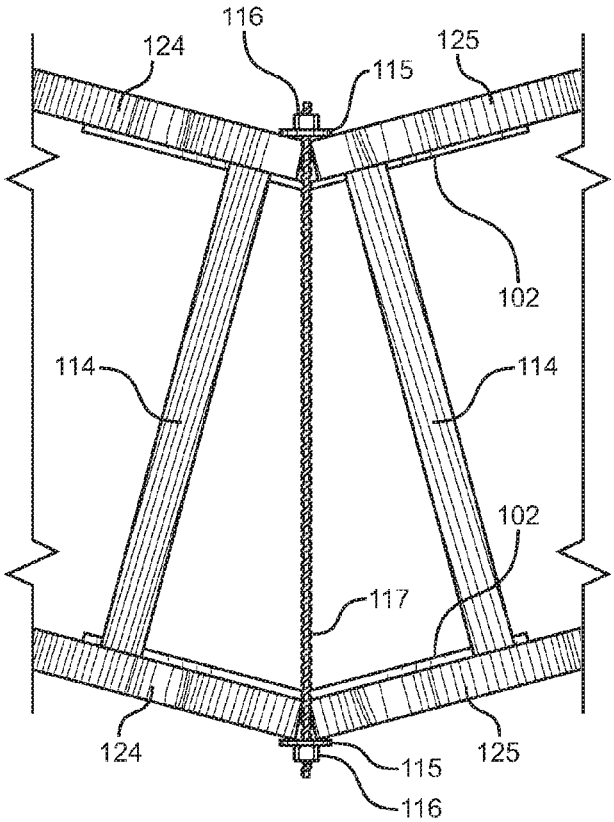
FIG. 7A is a plain view between the vertical columns showing a removeable wall thickness stabilizer system and threaded rods, as in an embodiment of the present invention.

FIG. 7A illustrates the removable wall thickness stabilizers to maintain the integrity and consistency in thickness of the structure of the earthen composite structural forming system of the present invention between the inner and outer pairs of vertical columns 110 and provides firmness to the columns 110 during assembly and afterwards. Wall thickness stabilizers are placed once the vertical columns 110 are assembled and the vertical columns 110 are erected and plumbed. An opposite pair of inner vertical columns 110 is connected to twin outer vertical columns 110 by using the precut two 2"×4"×18" jigs 114 placed at 3-foot-high intervals on a perpendicular plain as shown in FIG. 7A. A threaded rod 117 is place through the center of the vertical column 110 where the left 124 and right 125 vertical studs connect and is secured by at least one bolt 116, the bolt 116 being secured by a washer 115 at each end. In some preferred embodiments, the rod 117 and the two jigs 114 being on the same horizontal plane.

In some embodiments the bolt 116 is secured by 1" washers 115. In some embodiments, the threaded rod 117 comprises metal. In other embodiments the threaded rod 117 can comprise plastics, resins, epoxies, woods, natural structural materials, synthetic structural materials, and the like. In one preferred embodiment, the vertical column 110 is bolted 116 right at the 2"×4"×18" jigs 114 using ⅛" thick of one inch in diameter washer 115 on either side of the vertical columns 110. The same procedure is may be repeated 6' and 9' from the base of the vertical columns 110, as in one preferred embodiment. The jigs 114 are removed as the earthen composite dries and do not remain in the structure. The threaded rods 117 remain as the earthen composite structure is formed, and may be removed after the structure is complete.

Figure 7B:
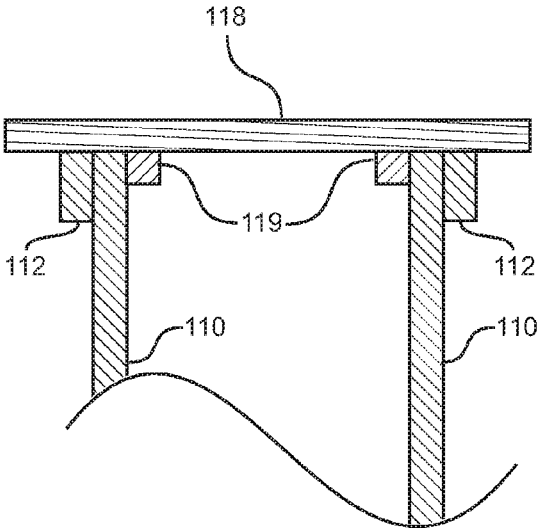
FIG. 7B illustrates a section view of the top plate jig, as in an embodiment of the present invention.

Moreover, in the preferred embodiment, a jig 118 as shown in FIG. 7B, is adhered to the uppermost portion of a vertical columns 110. In one preferred embodiment is the upper pole jig 118, being 2"×12"×24" and nailed to the uppermost portion of the vertical column 110. Additionally upper wooden strips 119 are part of the jig 118 connect the upper ends of the vertical columns 110. In some preferred embodiments, the top plates 119 comprises about four 1"×1"×16" wooden strips that are nailed to the upper pole jig 118 where the vertical columns 110 lean against to ensure consistency in wall thickness.

FIG. 7B illustrates a section view of the upper pole jig 118 and strips 119 and their action with the vertical column 110 and connecting studs 112.

Figure 7C:
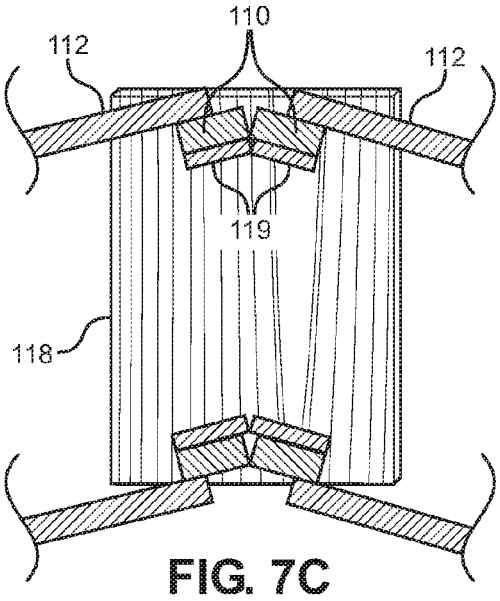
FIG. 7C is a top view; the top plate is another jig form with the same scope on the upper pole of the forming system, as in an embodiment of the present invention.

FIG. 7C illustrates a top view of the upper pole jig 118 between the left 124 and right 125 vertical studs comprising the vertical column 110. This view illustrates the rotation of the wooden strips 119 to the two vertical studs 124 and 125.

Figure 8:
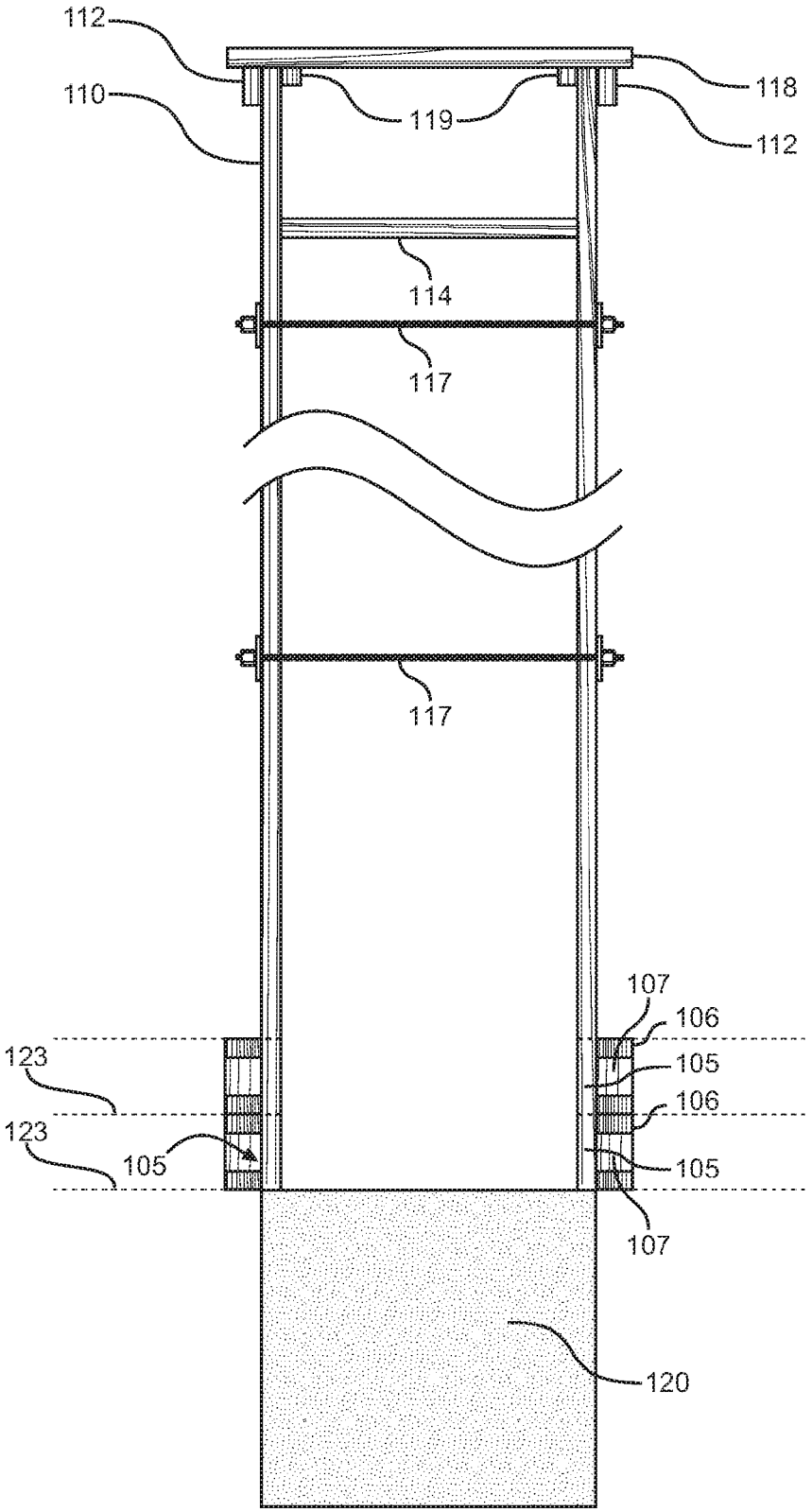
FIG. 8 is a cross-sectional view of the forming system, as in an embodiment of the present invention.

FIG. 8 shows a cross-sectional view of the earthen composite structural forming system wherein the foundation elements 120, secure the vertical columns 110 to the system. In other embodiments, the vertical columns 110 rest on the foundation 120. Horizontal boards 105 are first placed at the base of to adjacent vertical columns 110 and connected via flat plates 100. Inner and outer horizontal boards 105, with their horizontal and vertical stabilizing stabilizers 106 and 107, connected to adjacent inner and outer vertical columns 110 create an interstitial space that is filled by earthen composite 113. Once the composite is dried 121, the horizontal boards 105 are vertically advanced to, at most the vertical achievement of the dried earthen mixture 121, and in some embodiments, below the previous earthen composite's uppermost point 123 by approximately 1-6". FIG. 8 shows the upper most point 123 where the horizontal boards 105 will be placed at the next cycle.

The horizontal boards 105 are initially placed using the apertures with double headed nails 111 to a new vertical position, and are then secured by the fastening of plates 100 to the horizontal boards 105 and adjacent vertical columns 110 creating a new interstitial space to be filled with more earthen composite 113. Once deposited, the earthen mixture is left to sufficiently dry 121. As in other preferred embodiments, the earthen mixture 113 may be compacted to eliminate drying time 121. This process is repeated vertically, until a desired height of the wall is achieved. Where a multiplicity of walls are needed for a structure, horizontal boards 105 at an inner and outer position are provided at each corner on the same horizontal plane. As such, a complete level of horizontal earthen composite 113 is achieved at each drying time point.

Drying time points of the earthen mixture 113 are achieved in relation to water content of the earthen mixture, and the environment in which the structure is being build. In some embodiments, a low water with compaction will allow the earthen mixture 113 to be ready for the next cycle. While an arid environment may let a similar earthen composite 113 dry in 1 day, the same earthen composite 113 may need 6 days to sufficiently dry to proceed with the next cycle. Those of skill in the art are aware of the environmental and water content levels and dry time of earthen composites. Moreover, in a preferred embodiment, the earthen composite is Cob, or earthen mix with water content.

The upper pole connecting studs 112 as seen in FIG. 8 maintain the spacing and integrity of the vertical columns 110. A top plate 119 further maintains the integrity and spacing of the earthen composite forming system. Moreover, at variable heights through the wall, threaded rods 117 are placed to maintain the integrity and thickness of the earthen composite structure formed by the system. Moreover, as depicted in FIG. 8 thickness stabilizing jigs 114 maintain thickness of the composite system. In some preferred embodiments the threaded rods 117 are ¼" thick and are placed at three heights along the vertical columns 110. In some preferred embodiments the thick ness stabilizing jigs 114 are 2"×4"×18", the top plate 119 is of a dimension of 2"×12"×2', and the upper pole connecting studs 112 are 2"×4".

Figure 9:
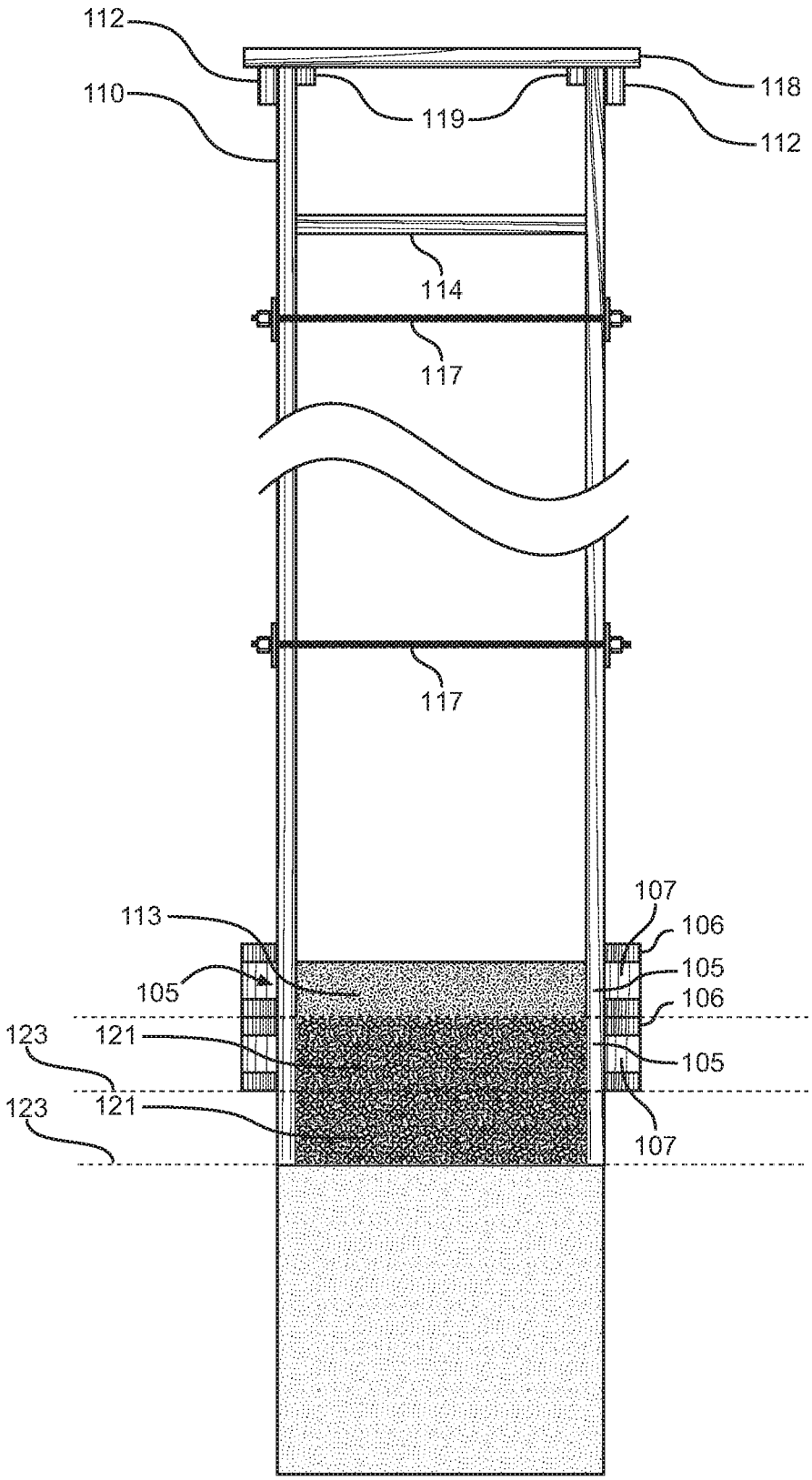
FIG. 9 is another cross-sectional view of the forming system, as in an embodiment of the present invention filled with earthen composite.

Similarly, FIG. 9 illustrates another cross-section view of the earthen composite (or mixture) system. The foundational elements 120 are at the base of the structure. The vertical columns 110 extend upwards to define the height and width of the structure. Two sets of horizontal boards 105 are placed on between the inner and outer vertical columns 110. Earthen composite mixture is placed between the space defined by the horizontal boards 105 and vertical columns 110. The mixture is compacted or dried 121. In the next sequence, the lower horizontal board will be removed and placed above the upper horizontal board, so that a new space will be created for a second layer of earthen composite mixture. Also note the threaded rods 117 which are disposed between the vertical studs comprising the vertical columns 110. An upper pole connecting beam 112 is attached to adjacent vertical columns 110 to maintain integrity of the structure.

Moreover, as is consistent with one embodiment of the present invention, once the entire earthen composite wall is complete, the horizontal boards 105 with their horizontal 106 and vertical 107 stiffeners, the vertical columns 110, upper pole connecting studs 112, top plate 119, and all materials including the placed threaded rods 117, may be dismantled and removed, and further used for framing, shelving, trimming of the inner space with the intent of recycling and minimizing waste. All supporting materials will be removed, including the vertical columns 110.

The earthen composite structural forming system may be packaged as kit, furthering the simplicity in execution for such structural dwellings.

While the compositions and methods of this disclosure have been described in terms of particular embodiments, it will be apparent to those of skill in the art that variations may be applied to the structures and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims. It will be understood that embodiments described herein are shown by way of illustration and not as limitations of the disclosure.

The principal features of this disclosure can be employed in various embodiments without departing from the scope of the disclosure. Those skilled in the art will recognize, or can ascertain using no more than routine study, numerous equivalents to the specific structures described herein. Such equivalents are within the scope of this disclosure and are covered by the claims. All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

Example 1

An kit and Itinerary is based on a 12-sided building of 12-foot maximum height and square footage of approximate 1,500 SF, the kit comprising:

1. 2"×12"×12' light weight wooden board (Spruce is what we used). Total of 50. 48 for the double raw of the horizontal boards and 2 board to be dimensioned at 2' length and nailed on the top of the 12 columns
2. 2"×6"×16' studs. Total of 48 for the vertical columns
3. 2"×4"×12' studs. Total of 140. 24 of them are used to connect the upper end of the columns, 104 (96+8) are used to stiffen the horizontal boards and a final 12 to be used on temporary base to be placed between the vertical boards to assure constant thickness of the forming system
4. 8"×8"×⅛" Aluminum plates, total of 96, all bended at 30-degree angle at the center and placed at 3-foot interval to tie the vertical pairs of 2'×6" internal and external columns
5. 8"×8"×⅛" Aluminum plates, total of 96 used to connect the horizontal boards to the columns
6. 2 large boxes of 10-1⅝" star head screws, for tying all plates to the forming system
7. 2 large boxes of 10-3" long star head screws to tie in the 2"×4" studs to the 12' boards for stiffening purpose
8. ¼"×2' long zinc oxide coated threaded rods total of 48 with the corresponding double nobs and 1½" diameter ¼" thick washers
9. Double headed 3" long nail to be nailed of the side of the columns at 1' interval to assure easier fastening and proper interval rising of the horizontal boards
10. 100'×20' plastic roll to proper the forming system from the rain when applicable
11. Two large boxes of 1" (⅛) washers with a ¼" opening Wherein, when used in a clay-based soil area, such as Chapel Hill, N.C., the ideal mix for the earthen composite mixture is 2 parts subsoil, one part course sand, 10-15% straw, and 5% water. Such mixture was compressively tested by making 10, 4" diameter by 8" tall samples, and was found to be suitable for construction of a structure employing the earthen composite forming system herein described.

A pit was be made in the ground equivalent to 6 cubic yards, and the earthen composite mixture was dispensed into the pit with a mini-excavator. After thorough mixing with a 3 ft. wide bucket, the final earthen composite mixture was carried and delivered into the forms created with the list of items and in accordance with the preceding description using the mini-excavator.

A 9" thick earthen composite mixture was leveled through the entire perimeter of the forming system, and was compacted (mechanically or manually) to 6". The same application was repeated 6" at a time. Every 2 lifts, the lower horizontal board was moved upward in an alternating fashion. Threaded rods were lifted every 2 feet to assure containment and consistent wall thickness. The procedure was repeated until the wall was complete. Based on geological, seismic, wind, and snow loaded further reinforcement, and should be considered by an assigned engineer. In this example, bamboo, rebar, and other reinforcements were applied.

I claim:

1. An earthen composite forming system comprising:

a plurality of inner and outer vertical columns, the vertical columns comprising a left and a right vertical stud and being connected with a stud connecting plate, wherein the inner vertical columns are located at an inner position to create an inner perimeter, and the outer vertical columns are located at an outer position to create an outer perimeter of a structure, and wherein one of the plurality of inner vertical columns and one of the plurality of the outer vertical columns are connected by a wall thickness stabilizer establishing a desired thickness, and wherein the inner and outer vertical columns are located adjacent to each other at a desired width, and wherein the adjacent inner columns and adjacent outer columns are connected by an upper pole connecting stud;

at least two inner and two outer horizontal boards, each horizontal board comprising horizontal and vertical stiffeners on one side, and being flat on an opposite side, wherein each horizontal board is positioned between adjacent inner or outer vertical columns, each horizontal board connecting to the respective vertical columns by a flat plate connecting the horizontal board to the left vertical stud of one vertical column and the right vertical stud of the adjacent vertical column, and wherein the inner and outer horizontal boards each comprise an upper horizontal board and a lower horizontal board;

threaded rods are located within a forming earthen composite wall to maintain structural integrity and maintain consistent thickness; and wherein the earthen composite wall is composed of (a) a first layer of earthen composite material positioned in an interstitial space defined by the vertical columns and horizontal boards creating a cavity wherein the first layer of earthen composite material is positioned and dried, and (b) one or more additional layers of earthen composite material positioned over and coextensive with the first layer where the lower inner horizontal and the lower outer horizontal boards are removed from the vertical columns and fastened to the vertical columns above and in connection with the upper inner horizontal board and the upper outer horizontal board thereby creating additional cavities where the additional layers of earthen composite material are positioned and dried until a desired height of a complete earthen composite wall is achieved.

2. The earthen composite forming system of claim 1, wherein the stud connecting plate has an angle of between 0 and 170 degrees.

3. The earthen composite forming system of claim 1, wherein a plurality of boards are configured to be located to exclude the earthen composite material, to form openings within the wall.

4. The earthen composite forming system of claim 1, wherein the inner and outer vertical columns are separated by a width 10-24 inches, forming the earthen composite wall of the same thickness.

5. The earthen composite forming system of claim 1, wherein the wall thickness stabilizer comprises at least two pieces placed between the vertical columns at intervals between 2½ and 3½ feet high on a perpendicular plane, and comprising a respective said threaded rod connecting the inner and outer vertical columns at a center point between the left and right vertical studs, and wherein the at least two pieces are removed from the forming system as the earthen composite wall is formed.

6. The earthen composite forming system of claim 1, wherein the components of the forming system are removed from the complete earthen composite wall.

7. An earthen composite forming system for an earthen composite wall comprising:

a plurality of inner and outer vertical columns, the vertical columns comprising a left and a right vertical stud and being connected with an angled stud connecting plate, wherein the inner vertical columns are located at an inner position to create an inner perimeter, and the outer vertical columns are located at an outer position to create an outer perimeter of a structure, wherein the inner and outer vertical columns are located adjacent to each other at a desired width, and wherein the adjacent inner columns and adjacent outer columns are connected by an upper pole connecting stud;

a wall thickness stabilizer system located in between and connecting one of the inner vertical columns and one of the outer vertical columns and comprising at least two pieces located between the vertical columns at intervals between 2½ and 3½ feet high on a perpendicular plane, and comprising a threaded rod connecting the inner and outer vertical columns at a center point between the left and right vertical studs and wherein the at least two pieces are removed from the forming system as the earthen composite wall is formed;

at least two inner and two outer horizontal boards, each horizontal board comprising horizontal and vertical stiffeners on one side, and being flat on an opposite side, wherein each horizontal board is positioned between adjacent inner or vertical columns, each horizontal board connecting to the vertical columns by a flat plate connecting the horizontal board to the left vertical stud of one vertical column and the right vertical stud of the adjacent vertical column, and wherein the inner and outer horizontal boards each comprise an upper horizontal board and a lower horizontal board; and wherein the earthen composite wall is composed of (a) a first layer of earthen composite material positioned in an interstitial space defined by the vertical columns and horizontal boards creating a cavity wherein the first layer of earthen composite material is positioned and dried, and (b) one or more additional layers of earthen composite material positioned over and coextensive with the first layer where the lower inner horizontal and the lower outer horizontal boards are removed from the vertical columns and fastened to the vertical columns above and in connection with the upper inner horizontal board and the upper outer horizontal board thereby creating additional cavities where the additional layers of earthen composite material are positioned and dried until a desired height of a complete earthen composite wall is achieved.

8. The earthen composite forming system of claim 7, wherein the angled stud connecting plate has an angle of between 10 and 170 degrees.

9. The earthen composite forming system of claim 7, wherein a plurality of boards are configured to be located to exclude the earthen composite material, to form openings within the wall.

10. The earthen composite forming system of claim 7, wherein the inner and outer pairs of vertical beams are separated at a width 10-24 inches, forming a wall of the same thickness.

11. The earthen composite forming system of claim 7, wherein the components of the forming system are removed from the complete earthen composite wall.

12. An earthen composite forming system for creating an earthen composite structure comprising:

a plurality of corners, wherein an angle of each corner is determined by a number and dimensions of desired sides, each corner having inner and outer vertical columns, the vertical columns comprising a left and a right vertical stud and being connected with an angled stud connecting plate, wherein the inner vertical columns are located at an inner position to create an inner perimeter, and the outer vertical columns are located at an outer position to create an outer perimeter of the structure, wherein inner vertical columns are located adjacent to each other at a desired width, and outer vertical columns are located adjacent to each other at a desired width, and wherein the adjacent inner columns and adjacent outer columns adjacent to each other are connected by an upper pole connecting stud;

a wall thickness stabilizer system located in between and connecting one of the inner vertical columns and one of the outer vertical columns at one of the corners and comprising at least two pieces located between the vertical columns at intervals of between 2½ and 3½ feet high on a perpendicular plane, and comprising a threaded rod connecting the inner and outer vertical columns between the left and right vertical studs, and wherein the at least two pieces are removed from the forming system as the earthen composite structure is formed;

at least two inner and two outer horizontal boards, each horizontal board comprising horizontal and vertical stiffeners on one side, and being flat on an opposite side, wherein each horizontal board is positioned between adjacent inner or vertical columns, each horizontal board connecting to the vertical columns by a flat plate connecting the horizontal board to the left vertical stud of one vertical column and the right vertical stud of the adjacent vertical column, and wherein the inner and outer horizontal boards each comprise an upper horizontal board and a lower horizontal board; and wherein the earthen composite structure is composed of (a) a first layer of earthen composite material positioned in an interstitial space defined by the vertical columns and horizontal boards creating a cavity wherein the first layer of earthen composite material is positioned and dried, and (b) one or more additional layers of earthen composite material positioned over and coextensive with the first layer where the lower inner horizontal and the lower outer horizontal boards are removed from the vertical columns and fastened to the vertical columns above and in connection with the upper inner horizontal board and the upper outer horizontal board thereby creating additional cavities where the additional layers of earthen composite material are positioned and dried until a desired height of a complete earthen composite structure is achieved.

13. The earthen composite forming system of claim 12, wherein the angled stud connecting plate has an angle of between 10 and 170 degrees.

14. The earthen composite forming system of claim 12, wherein a plurality of boards are configured to be located to exclude the earthen composite material, to form openings within the structure.

15. The earthen composite forming system of claim 12, wherein the inner and outer pairs of vertical beams are separated at a width 10-24 inches, forming a wall of the same thickness.

16. The earthen composite forming system of claim 12, wherein the components of the forming system are removed from the complete earthen composite structure.

* * * * *